US006226944B1

(12) United States Patent
Peshkam et al.

(10) Patent No.: US 6,226,944 B1
(45) Date of Patent: May 8, 2001

(54) REINFORCED STRUCTURAL MEMBER

(75) Inventors: Vahigh Peshkam, Guildford; Polycarp S. Shole-Luke, Epsom; Michael B. Leeming, London, all of (GB)

(73) Assignee: Mouchel Consulting Limited (GB)

( * ) Notice: Subject to any disclaimer, the term of this patent is extended or adjusted under 35 U.S.C. 154(b) by 0 days.

(21) Appl. No.: 09/285,779

(22) Filed: Apr. 5, 1999

Related U.S. Application Data

(63) Continuation-in-part of application No. 08/409,465, filed on Mar. 24, 1995, now abandoned.

(30) Foreign Application Priority Data

Mar. 25, 1994 (GB) ..... 9405982

(51) Int. Cl.[7] ..... E04C 1/00

(52) U.S. Cl. ..... 52/309.8; 52/309.1; 52/582.1; 52/586.1; 52/630; 52/720.1; 52/737.6

(58) Field of Search ..... 52/724.1, 724.3, 52/724.4, 724.5, 731.2, 732.1, 737.4, 737.6, 738.1, 720.1, 730.1, 731.1, 654.1, 309.1, 309.8, 309.9, 309.11, 630

(56) References Cited

U.S. PATENT DOCUMENTS

| | | | |
|---|---|---|---|
| 374,271 | 12/1887 | Rodemer . | |
| 596,217 | 12/1897 | Rapp . | |
| 742,943 | * 11/1903 | Wight | 52/724.4 |
| 764,772 | 7/1904 | Rydahl . | |
| 778,416 | 12/1904 | Kyle . | |
| 1,568,252 | 1/1926 | Strub . | |
| 1,990,001 | 2/1935 | Rutten . | |
| 2,116,886 | 5/1938 | Goetz . | |
| 2,362,162 | 11/1944 | Sheldon . | |
| 3,113,401 | 12/1963 | Rose . | |
| 3,331,177 | 7/1967 | Godfrey . | |
| 3,386,218 | 6/1968 | Scott . | |
| 3,427,773 | 2/1969 | Kandall . | |
| 3,727,362 | 4/1973 | Ellison et al. . | |
| 4,030,265 | 6/1977 | Allgood . | |
| 4,181,556 | 1/1980 | Fehlmann . | |
| 4,538,392 | 9/1985 | Hamar et al. . | |
| 4,615,166 | * 10/1986 | Head | 52/309.11 |
| 4,795,666 | 1/1989 | Okada et al. . | |
| 4,843,777 | 7/1989 | Shimabukuro . | |
| 4,856,256 | 8/1989 | Tokuzo . | |
| 5,102,710 | 4/1992 | Kaufman et al. . | |
| 5,348,778 | 9/1994 | Knipp et al. . | |

FOREIGN PATENT DOCUMENTS

| | | |
|---|---|---|
| 1965272 | 7/1971 | (DE) . |
| 3115760 | 3/1983 | (DE) . |
| 3307753 | 9/1983 | (DE) . |
| 8811686 | 12/1988 | (DE) . |
| 2 115 452 | 9/1983 | (GB) . |
| WO93/19261 | 9/1993 | (WO) . |
| WO93/24714 | 12/1993 | (WO) . |

* cited by examiner

*Primary Examiner*—Michael Safavi
(74) *Attorney, Agent, or Firm*—Nixon & Vanderhye P.C.

(57) ABSTRACT

An elongate structural member used in structural applications. The structural member has an outer shell of uniform cross section with at least one arcuate reinforcing member within the outer shell. The structural member outer shell as well as the arcuate reinforcing member being made from a fiber reinforced polymeric composition. Connecting members allow for attachment of a plurality of structural members one to another for forming floors, roofs, and walls.

23 Claims, 11 Drawing Sheets

REINFORCED STRUCTURAL MEMBER

This application is a continuation-in-part of application Ser. No. 08/409,465, filed Mar. 24, 1995, now abandoned.

BACKGROUND OF THE INVENTION

The present invention relates to a reinforced structural member for use in applications where load carrying capability is required, for example structural, semi-structural and cladding applications to carry floor loading, walkway loading, wheeled loading, pressure loading in buildings, bridges etc.

Traditionally, solid members have been used in the above applications. Recently sectioned members have been proposed but these are mainly box-section members such as those described in WO 91/06421

BRIEF SUMMARY OF THE INVENTION

The present invention provides an elongate structural member comprising of an outer shell of substantially rectangular lateral cross section and at least one substantially laminar arcuate reinforcing member within the outer shell.

The reinforcing member is arcuate in a plane perpendicular to the axis of said structural member and extends between positions near opposite edges of one major face of the outer shell. The mid section of the reinforcing member approaches near the opposite face.

The present invention provides a member which has improved strength characteristic by efficiently transmitting loads to the bottom corners or intermediate points across the section, while providing stiffness in the longitudinal direction, preventing local buckling of the wide upper flange and resistance to in-plane loading.

It is envisaged that the space between the arcuate member and the load bearing surface opposing the arcuate surface may be filled with a foam material and/or may have rib members extending between them.

Both the outer shell and the arcuate member may be constructed by either molding or pultruding them from fiber reinforced composite materials. This provides the member with the strength required whilst retaining a lightweight construction.

When load is applied to the load bearing surface, it is passed through the arch to the base of the structural member where it is transmitted to the supports at suitable points along the length of the member. In order to prevent the ends of the arch from splaying outwards they are restrained in one of two ways. Either, a planar sheet of a similar material to the rest of the outer shell is used to restrain the ends of the arch and also forms the base of the structural member or tension members such as wires or strips are provided spaced along the length of the structural member connecting the opposite sides of the arch to hold them in position.

It is also envisaged that to provide improved performance especially when high in-plane forces are encountered, reverse arching may be used. In such instances the structural member would contain two intersection arcuate members, one hogging and one sagging. This also allows the member to be used either way up, avoiding the need to check which way up the arcuate member is within the outer member when positioning the member.

If the structural members are to be used in combination, connecting portions may be provided to allow attachment of the units to each other to form floors, decks, roofs, walls, beams and columns of buildings, bridges and other forms of structure.

If the structural members are to be suspended in use then hanger portions may be provided to allow attachment to the hanging means.

DESCRIPTION OF THE DRAWINGS

The present invention will be further described hereinafter with reference to the following description of exemplary embodiments and the accompanying drawings, in which.

In the figures, like parts are indicated by like reference numerals.

DETAILED DESCRIPTION

Figure 1:
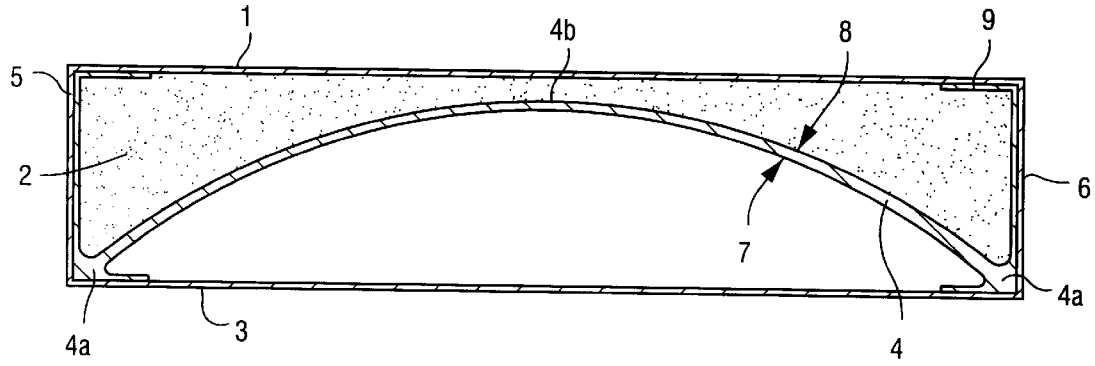
FIG. 1 shows an example of the basic configuration having foam filled spandrels.

FIG. 1 shows the basic configuration of a first embodiment of the present invention. The structural member comprises an outer member consisting of the load bearing surface 1, two side faces 5 and 6, a fourth face 3, and an arcuate member 4. Load applied to the structural member is passed through the load bearing surface 1 to the upper surface of the arcuate member 4. The load is supported by the strength of the arch and is passed to the ends 4*a*. As load is applied to the arch there is a tendency for the ends 4*a* to splay out unless they are restrained. Such a restraining force is provided, in use, by the fourth face 3 which holds the ends of the arch together and hence holds the arch in shape.

The space 2 defined between the convex surface 8 and the inside of the load bearing surface is filled with a foam material to help to distribute the load evenly to the arcuate member.

The arcuate member 4 may be formed as a single unit with the outer member (1,3,5,6) or formed separately and inserted into the outer member subsequently. Reinforcements 9 may also be used in the corners of the outer member to increase the overall stiffness and strength of the structural member. The reinforcement may be formed as part of the outer shell, part of the arcuate member or formed as a separate entity to be inserted into the outer member. The outer shell and arcuate member may have a laminated structure or be formed in a single piece.

Figure 2:
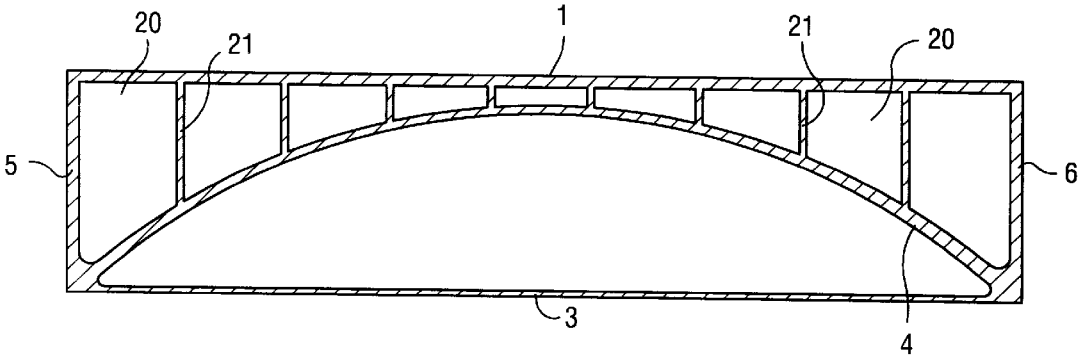
FIG. 2 shows the basic configuration with reinforcing ribs provided between the arch and the load bearing surface.

The structural member may also be constructed with or without a foam filling in the space 2 by using reinforcing ribs 21 to distribute the load onto the arcuate member, as shown in FIG. 2. The ribs may extend parallel to the axis of the structural member and perpendicular to the load bearing surface as in FIG. 2. However it is envisaged that there may be alternative ways of arranging the ribs, for example a fan like arrangement where the ribs are parallel to the axis of the structural member and perpendicular to a tangent at the point of intersection with the arcuate member.

Figure 3:
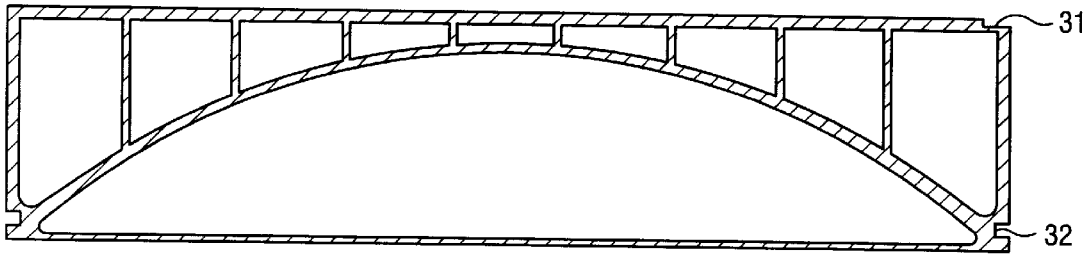
FIG. 3 shows the embodiment of FIG. 2 with hanger and connection portions for hanging and connecting the members in use.

The structural members may also be used by resting them on supports or by hanging them from a hanging means such as wires. To this end the structural members may be provided with hanging portions 31 and 32 as shown in FIG. 3 to allow attachment to such a hanging means.

Figure 4:
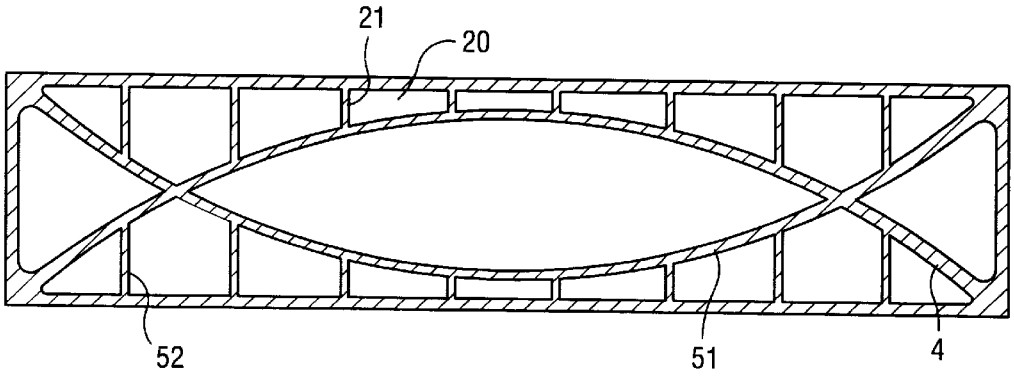
FIG. 4 shows a further embodiment having two intersecting arches.

FIG. 4 shows an alternative construction of the present invention comprising two arcuate members which intersect each other. The second arcuate member 51 is curved in the opposite sense to the other arcuate member 4. Extra ribs 21 and 52 may be included similarly to the ribs 21 shown in FIG. 2. As with previous embodiments the spaces between the ribs may be filled with a foam material. Alternatively some or all of the ribs may be excluded completely whilst still using the foam filler as in the configuration shown for a single arch in FIG. 1.

In use the structural member may be used with several similar members adjacent to it to form a floor or deck and so on. They may also be configured with adjacent members perpendicular or at inclined angles. To accommodate this, connection portions 41–44 as shown in FIGS. 5 & 6 may be included to facilitate connection to adjacent structural members or to inter-connect members as described below.

Figure 5:
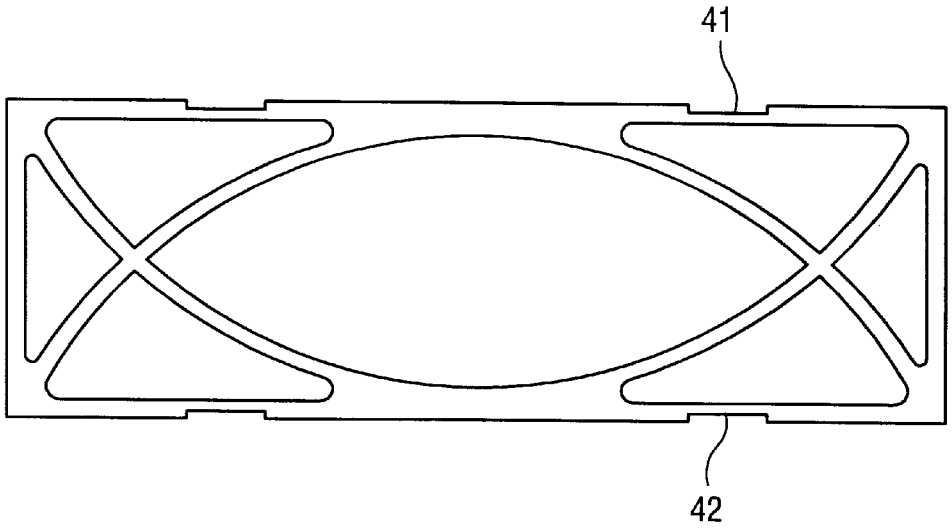
FIGS. 5 and 6 show two embodiments with two intersecting arches having the different connection portions.
Figure 6:
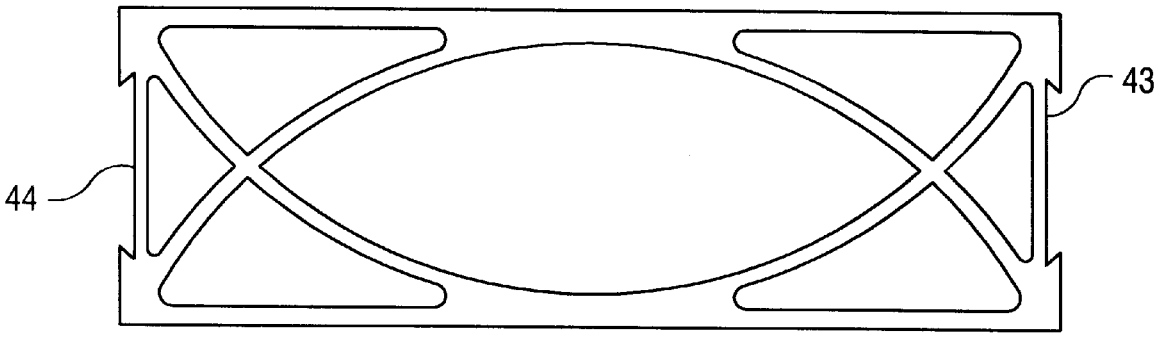
Figure 7:
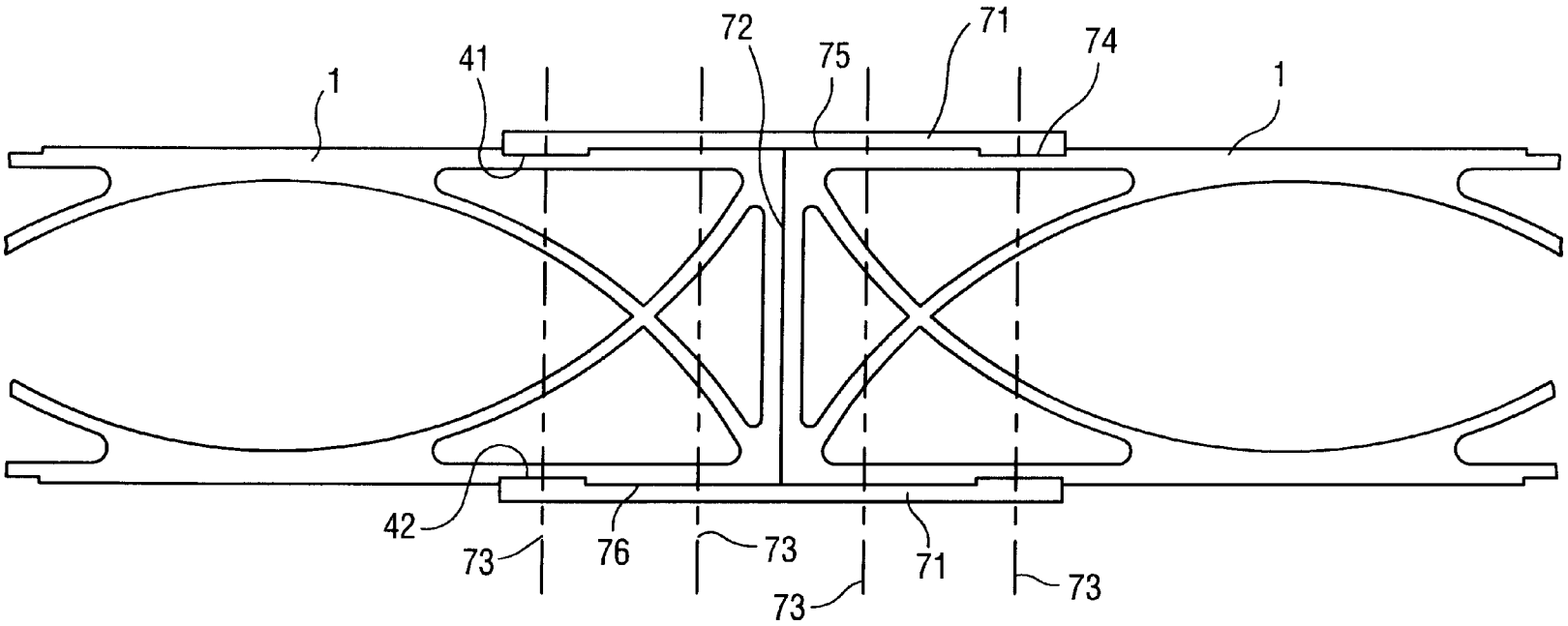
FIG. 7 shows a detailed view of the connection of two members using the first type of connection member.

FIG. 7 shows an example of two of the members shown in FIG. 5 connected together by connection members 71. The connection members have outstanding portions 74 which are shaped to engage the recess portions 41 provided on the structural member. The two members to be connected are bonded together along their abutting surfaces 72 and to the connection members along interfaces 75 and 76. It is also envisaged that the connecting members will be connected to each other via a web portion (not shown) which rungs between the edges of the members 1. Then in order to join members, the two members are slid into each side of the connecting member until the outstanding portions 74 engage the recess portions 41 such that the edge faces of the members abut against the web portion. In such a construction the edges of the members are bonded to the web portion as opposed to each other, as in the previous construction. In order to increase the strength of the joint a bolt may be passed through the connection members and the structural members to clamp the parts together. The possible positions of the bolts are indicated by dashed lines 73 in FIG. 7.

Figure 8:
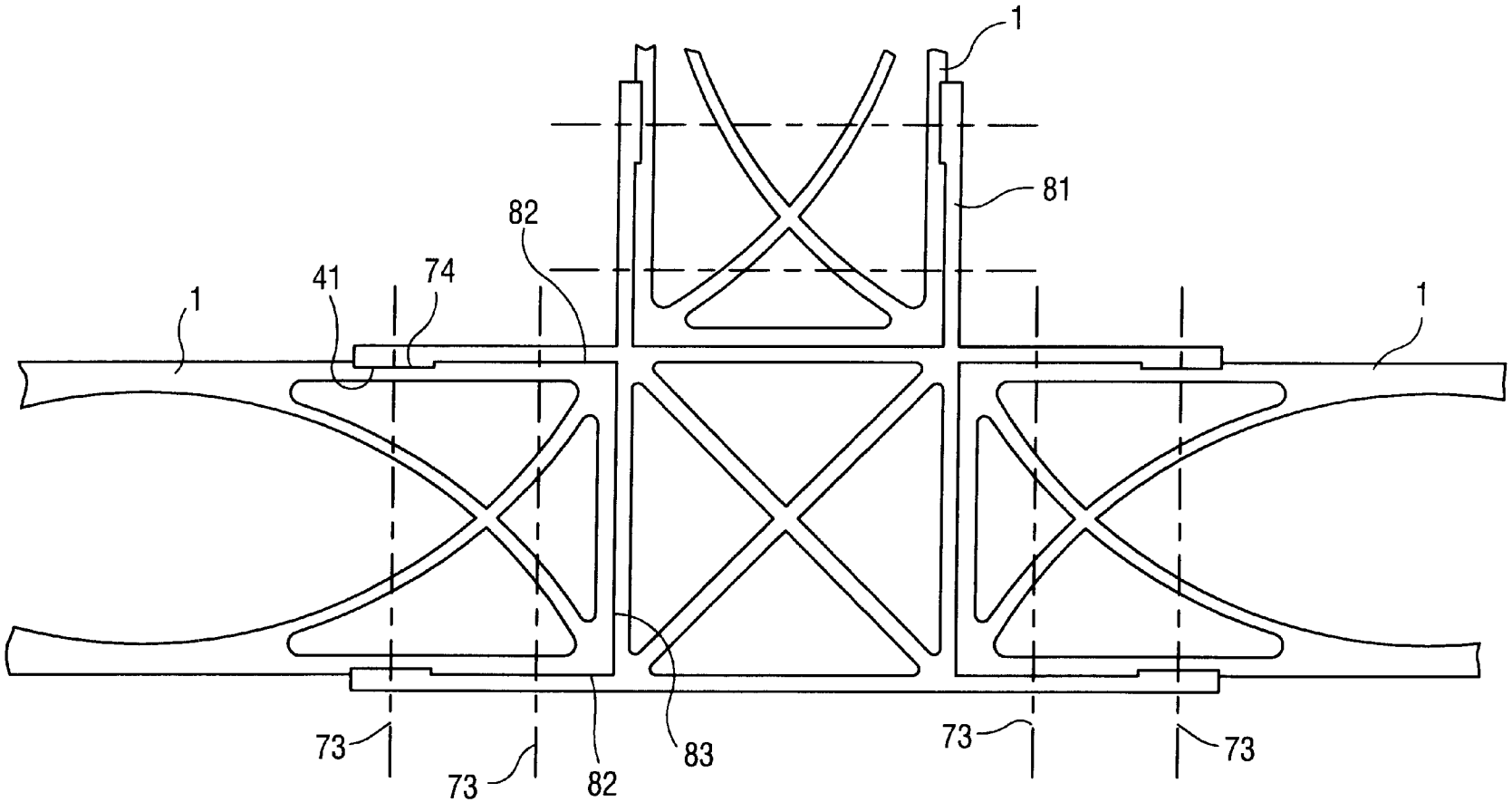
FIG. 8 shows a detailed view of the connection of three members using a T-shaped configuration of the first type of connection member.
Figure 9A:
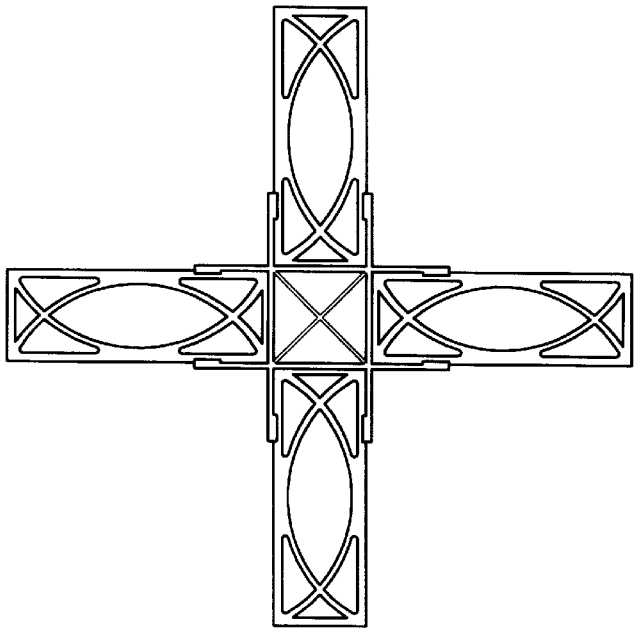
FIGS. 9A–D shows four possible modes of connection using four different configurations of the first type of connection member.
Figure 9B:
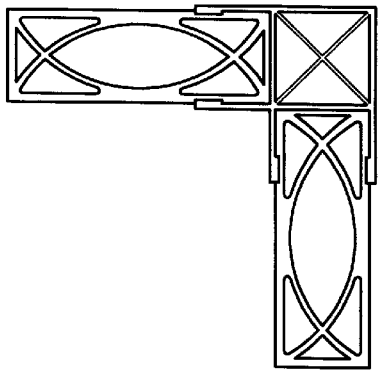
Figure 9C:
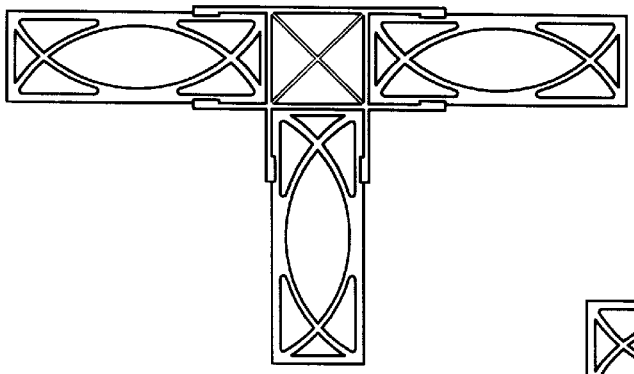
Figure 9D:
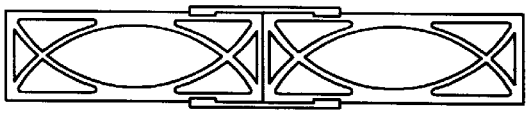

FIG. 8 shows an example of a connection member for connecting three structural numbers of the type shown in FIG. 5. Again each of the three structural members in inserted into the D-shaped connection member to which they are subsequently bonded along the member's edge 83 and upper and lower 82 surfaces.

FIGS. 9A to 9D illustrate the various forms of connection member usable with the first connection system. This includes the cross junction of FIG. 9A, corner junction of FIG. 9B, T-junction of FIG. 9C and a series junction of FIG. 9D.

Figure 10:
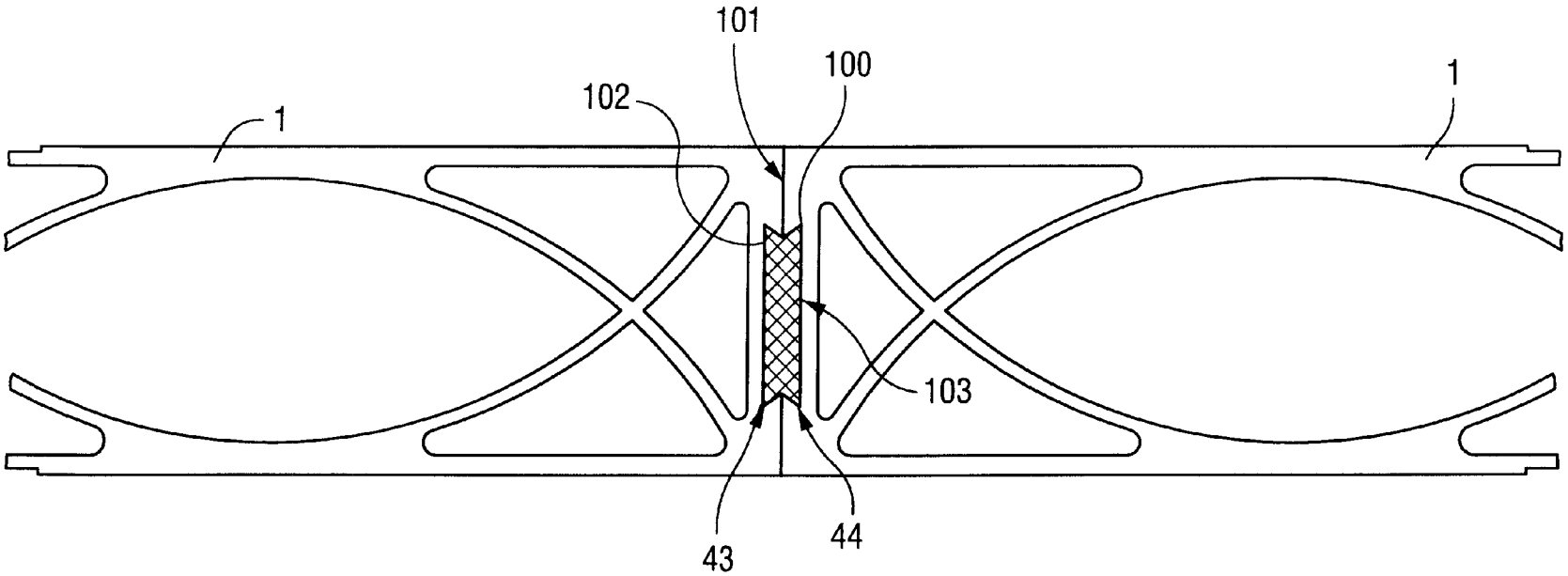
FIG. 10 shows a detailed view of the connection of members using a second type of connection member.

As shown in FIG. 10, a connection method for the embodiments shown in FIG. 6 comprises undercut recesses 43, 44 into which is inserted a connection member 100 having overhanging portions 102 adapted to engage the recess portions 43, 44 to retain the connection member in the slot. By inserting the similarly overhanging portion on the opposite side of the connecting member to the undercut recess slot of another member it is possible to hold two members together. When the two members to be connected are engaged with the connecting member, their edge faces come into abutting contact. The contacting surfaces 101 and 103 are then bonded to provide a permanent connection.

Figure 11:
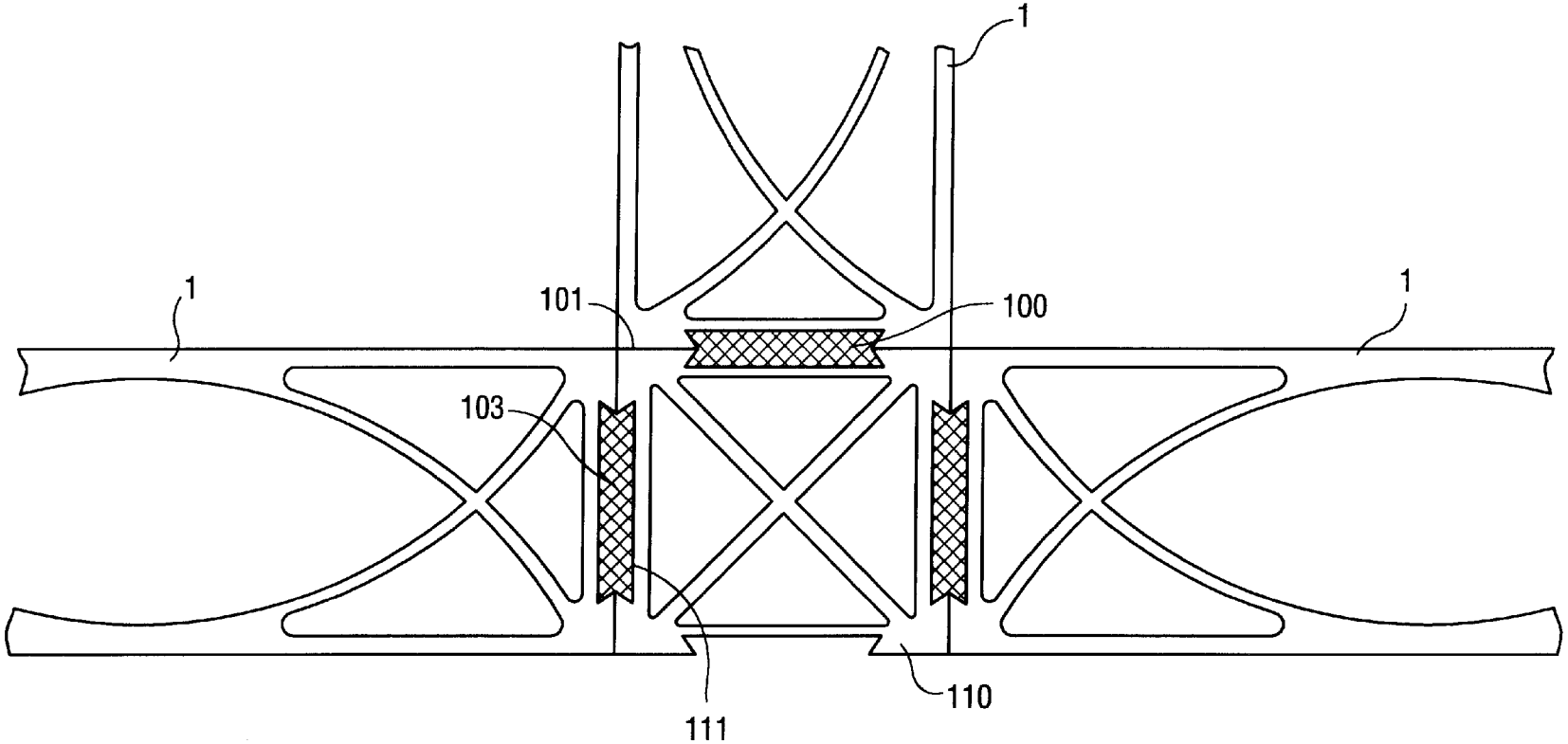
FIG. 11 shows a detailed view of the connection of three members using the second type of connection member and using an inter-connect piece.
Figure 12A:
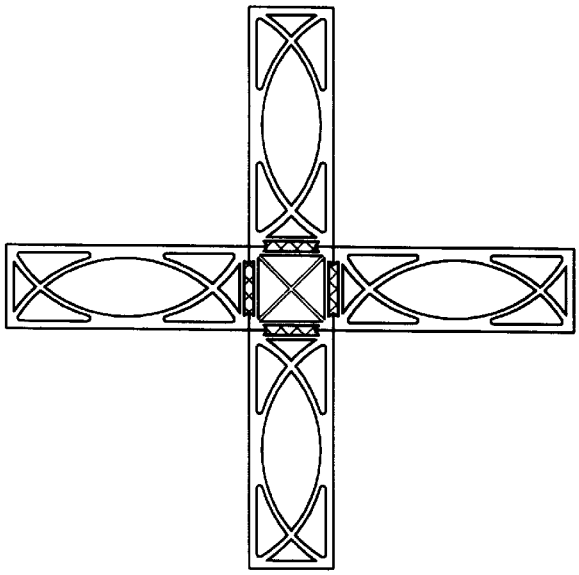
FIGS. 12A–D shows four possible modes of connection using the second type of connection means.
Figure 12B:
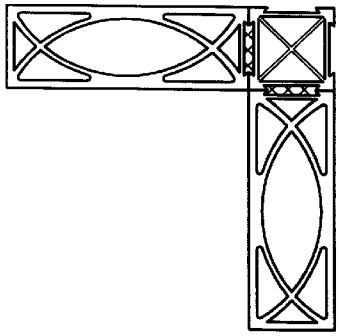
Figure 12C:
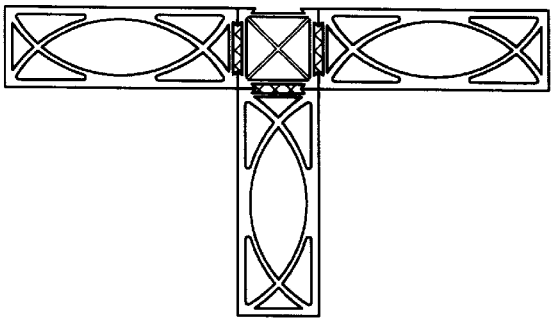
Figure 12D:
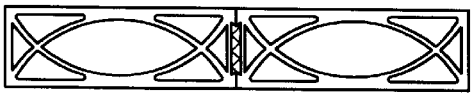

It is possible to connect the structural members in a T-junction format using an interconnect member 110 having undercut slots 111 similar to those on the structural members 1 to engage with the connecting members 100. FIG. 11 shows a typical construction of a T-junction using the connection members 100 and the interconnect member 110.

Again use of such an interface member allows various different configurations for joining the members (1) together. These are shown in FIGS. 12A to 12D corresponding to FIGS. 9A to 9D.

Figure 13:
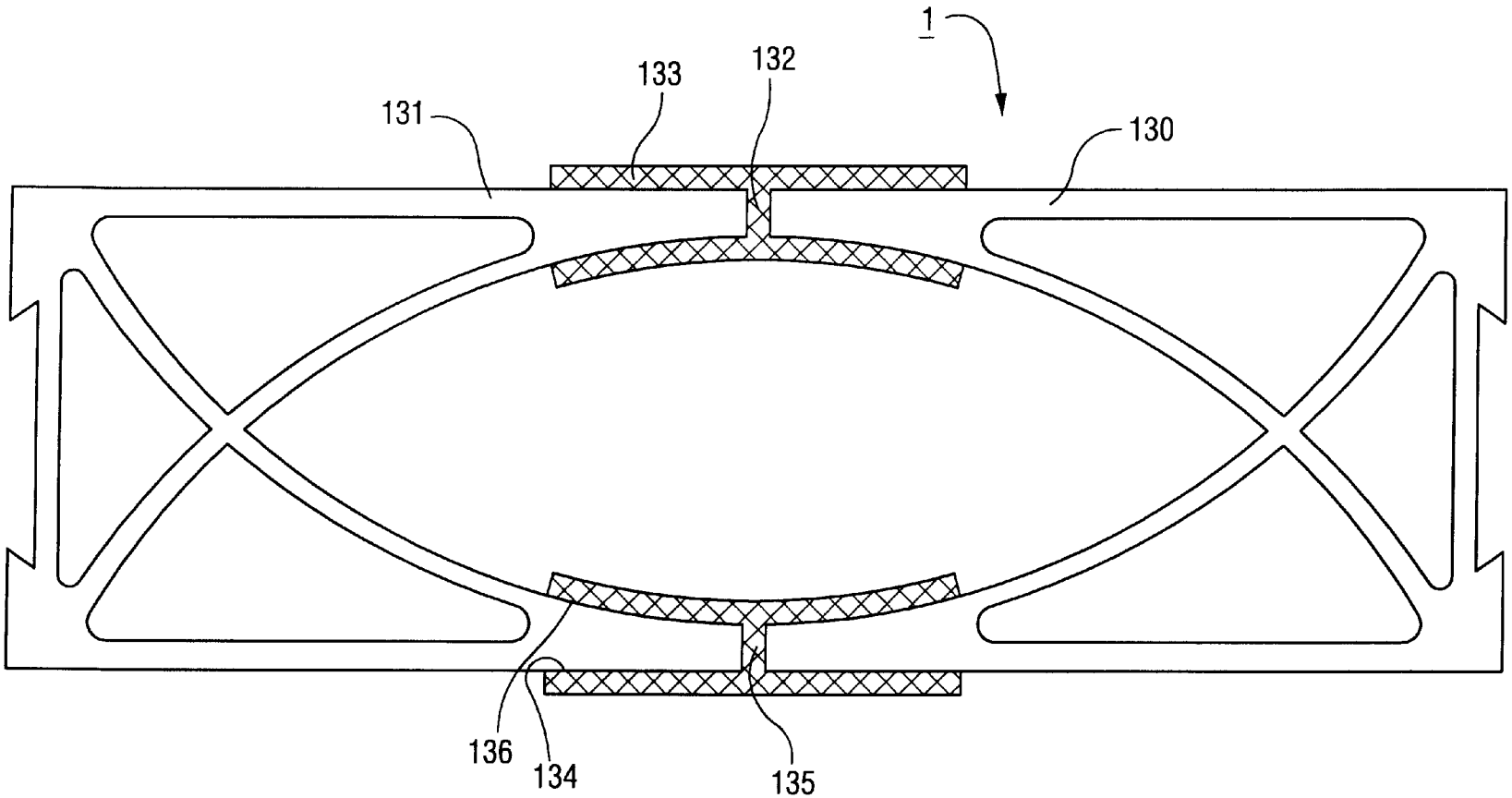
FIG. 13 shows a member according to the present invention formed in two-parts and bonded via a bonding member.

The structural members according to the present invention may be constructed in a number of different ways. For example the FIG. 1 construction has the outer shell and the arcuate member constructed separately, the arcuate member then being inserted into the outer shell on construction. Alternatively the members may be formed in a single stage by molding or pultruding them from fiber reinforced composite materials. Another method of construction is shown in FIG. 13 where the structural member is formed in two halves 130, 131 which are then either bonded together directly or, as shown in FIG. 13 bonded via a bonding member 132. The bonding member having a web portion 135 against which the edges of the halves of the structural member 130, 131 are abutted, and flange members 133 which also abut against the inside 136 and outside 134 surfaces of the halves 130, 131 of the structural member. The two halves and the bonding members are then bonded together at these contact surfaces to form the structural member.

Figure 14:
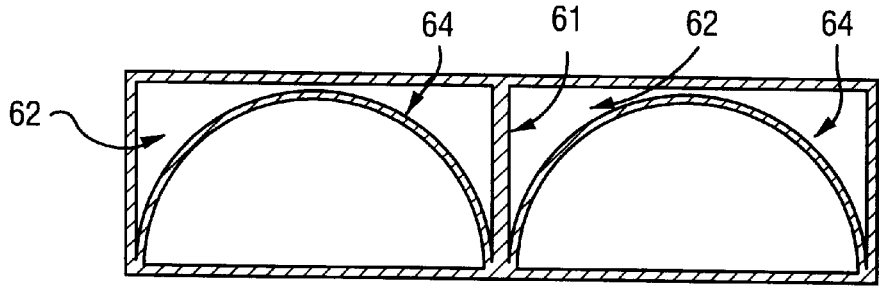
FIG. 14 shows a multi-cellular embodiment of the present invention.

A further embodiment of the present invention is shown in FIG. 14. This figure shows a multicellular structural member comprising two arcuate members 64 within a single outer member although it is envisaged that three or more arcuate members may be used. The arcuate members may be separated by rib members 61 as shown in FIG. 6. Again the spaces 62 may be filled with a foam material and/or have rib members 21 to distribute the load.

Figure 15:
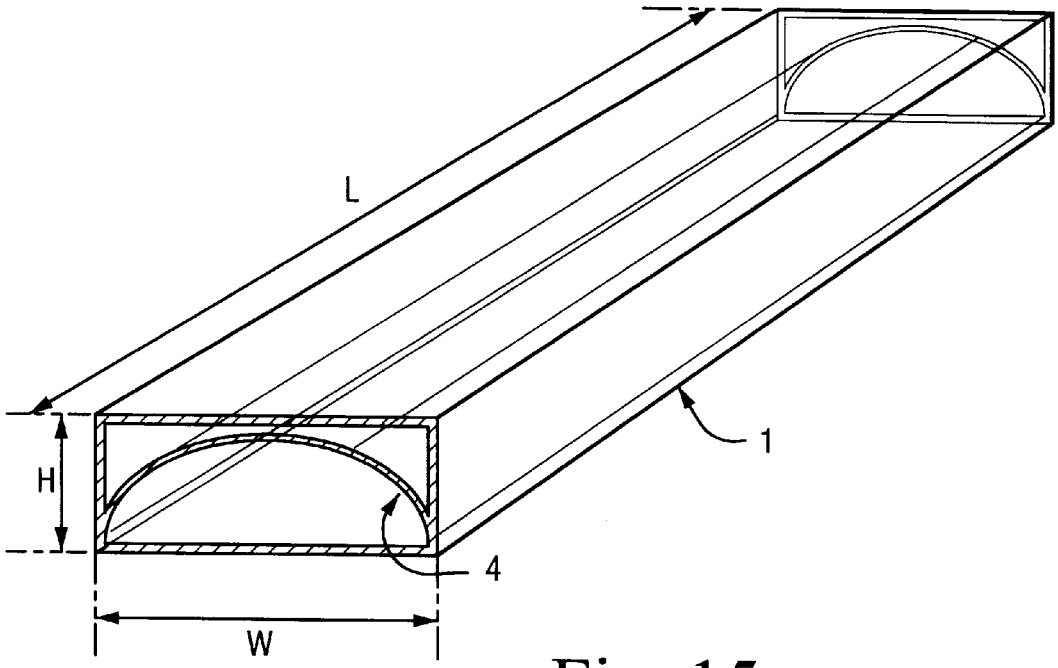
FIG. 15 is a prospective view of a structural member according to the invention showing its dimensions.

As shown in FIG. 15 the structural member of the present invention is considerably wider than it is tall and considerably longer than it is wide. In a preferred embodiment the height (thickness) (from the face spanning the open side of the arcuate member to the face approached by the apex of the arcuate member) to width (across the open side of the arcuate member) aspect ratio H:W in the range of 1:2 to 1:3, preferably 1:2:5. The width to length aspect ration, W:L, is 1 to 2.5 or longer. Presently preferred embodiments have dimensions of 600 mm (width)×250 mm (height) or 900 mm (width)×330 mm (height) and length 2500 mm or more.

It will be appreciated that, although the basic single arch embodiment is illustrated in FIG. 15, the same dimensions and aspect ratios apply to the other variations described above.

All of the structural variants described above are preferably manufactured from an advanced composite material comprising a high modulus, high strength and high aspect ratio reinforcing material encapsulated by and acting in concert with a polymeric matrix. In preferred embodiments the reinforcing material comprises long fibers of one or more of: E glass, R glass, carbon or aramid. The polymeric matrix comprises one or more of epoxy, vinyl ester, phenolic or isophthalic resins. The fibers occupy from 60% to 80%, preferably 70%, of the material by volume.

The structural member is preferably manufactured by a pultrusion or prepreg process and may be manufactured in continuous lengths which are subsequently cut to size.

In the major faces, top and bottom as shown in FIG. 15, from 65% to 95% of the fibers will be oriented longitudinally with the remainder at 90° and/or ±45° for the longitudinally axis. Of the longitudinal and lateral fibers 95% or more will extend the full length or width of the member. In the side (web) members and the arcuate member(s) from 20% to 80% will be oriented longitudinally with the remainder again at 90° and/or ±45°. Again, 95% or more of the fibers will extend to full length or width of the member.

What is claimed is:

1. An elongate structural member having a longitudinal axis, a length parallel to said longitudinal axis, a width perpendicular to said longitudinal axis and a thickness perpendicular to said longitudinal axis, the structural member comprising;

an outer shell having a substantially uniform outer shell lateral cross-section along substantially all the length of said structural member, said outer shell having first and second opposite major faces and first and second side faces joining said major faces; and a reinforcing member surrounded by said outer shell, said reinforcing member having a substantially uniform reinforcing member lateral cross-section along substantially all the length of the structural member, said reinforcing member lateral cross-section comprising an arc spanning the width of said outer shell, the edges of said reinforcing member being joined to said outer shell at or near the edges of said first major face and the medial portion of said reinforcing member being nearest said second major face;

wherein said length is greater than said width; said width is greater than said thickness; and said outer shell and said reinforcing member are formed of a composite material comprising long fibers embedded in a polymeric matrix.

2. A member according to claim 1 wherein said fibers are one or a mixture of fibers from the group consisting of E glass fibers, R glass fibers, carbon fibers and aramid fibers.

3. A member according to claim 1 wherein said polymeric matrix is formed of one or a mixture of materials from the group consisting of epoxy resins, vinyl ester resins, phenolic resins and isophthalic resins.

4. A member according to claim 3 wherein said long fibers are present in an amount of from about 60% to about 80% by volume of said composite material.

5. A member according to claim 1 wherein the average length of said long fibers is greater than said thickness.

6. A member according to claim 5 wherein, in said major faces, from about 65% to about 95% of said fibers are longitudinal fibers oriented substantially parallel to said longitudinal axis, and the remaining fibers are lateral fibers oriented at 90° and/or +45° and or −45° to said longitudinal axis.

7. A member according to claim 6 wherein at least 95% of said longitudinal fibers extend across the entire length of said member and at least 95% of said lateral fibers extend across the entire width of said members.

8. A member according to claim 5 wherein, in said reinforcing member, from about 20% to about 80% of said fibers are longitudinal fibers oriented substantially parallel to said longitudinal axis, and the remaining fibers are lateral fibers oriented at 90° and/or +45° and/or −45° to said longitudinal axis.

9. A member according to claim 8 wherein at least 95% of said longitudinal fibers extend across the entire length of said member and at least 95% of said lateral fibers extend across the entire width of said members.

10. A member according to claim 1 wherein the ratio of said width to said thickness is in the range of from about 1:2 to 1:3.

11. A member according to claim 1 wherein said length is at least 2.5 meters.

12. A member according to claim 1 wherein said width is at least 600 mm.

13. A member according to claim 1 wherein said thickness is at least 250 mm.

14. A member according to claim 1 including a second arcuate member contained within the outer shell, said arcuate members being curved in opposite senses.

15. A member according to claim 14 wherein said arcuate members intersect one another.

16. A member according to claim 1 comprising at least one rib member extending between a convex surface of the arcuate member and said second major face of the outer shell.

17. A member according to claim 1 comprising foam material in at least one space formed between a surface of the arcuate member and the outer shell.

18. A member according to claim 1 wherein said outer shell and said reinforcing member are molded or pultruded.

19. A member according to claim 1 wherein the outer shell comprises at least one connection portion to allow connection to at least one other member either directly or via a connection member.

20. A member according to claim 19 wherein said connection portion comprises at least one engaging recess on one of said faces of said outer shell.

21. A member according to claim 19 wherein said connection portion comprises at least one undercut recessed portion on one of said edges.

22. An elongate structural member according to claim 1 wherein the outer member comprises at least one hanger portion for hanging the elongate structural member.

23. A composite elongate structural member comprising:

two elongate structural members having mutually parallel longitudinal axes, a length parallel to said longitudinal axis, a width perpendicular to said longitudinal axis and a thickness perpendicular to said longitudinal axis, each structural member comprising:

an outer shell having a substantially uniform outer shell lateral cross-section along substantially all the length of said structural member, said outer shell having first and second opposite major faces and first and second side faces joining said major faces; and a reinforcing member surrounded by said outer shell, said reinforcing member having a substantially uniform reinforcing member lateral cross-section along substantially all the length of the structural member, said reinforcing member lateral cross-section comprising an arc spanning the width of said outer shell, the edges of said reinforcing member being joined to said outer shell at or near the edges of said first major face and the medial portion of said reinforcing member being nearest said second major face;

wherein said length is greater than said width; said width is greater than said thickness;

said outer shell and said reinforcing member are formed of a composite material comprising long fibers embedded in a polymeric matrix; and a side face of one structural member forming a side face of the other structural member.

* * * * *